United States Patent [19]

Skolnik et al.

[11] Patent Number: 5,024,597

[45] Date of Patent: Jun. 18, 1991

[54] PROCESS AND APPARATUS FOR KOSHERING CONTAINER LIDS

[75] Inventors: Howard Skolnik, Chicago, Ill.; Jonah Gewirtz, Silver Spring, Md.

[73] Assignee: Skolnik Industries Inc., Chicago, Ill.

[21] Appl. No.: 564,094

[22] Filed: Aug. 8, 1990

Related U.S. Application Data

[63] Continuation-in-part of Ser. No. 550,298, Jul. 9, 1990, which is a continuation-in-part of Ser. No. 348,803, Aug. 8, 1988, which is a continuation-in-part of Ser. No. 131,291, Dec. 8, 1987, Pat. No. 4,830,675, which is a continuation of Ser. No. 872,016, Jun. 9, 1986, abandoned.

[51] Int. Cl.[5] ..... F27B 9/00

[52] U.S. Cl. ..... 432/2; 134/2; 134/19; 134/20; 134/22.1; 134/40; 134/42; 110/236; 432/59; 432/75; 432/124; 432/224

[58] Field of Search ..... 134/2, 3, 40, 36, 41, 134/20; 252/118; 432/124, 224, 2, 59, 75; 110/236

[56] References Cited

U.S. PATENT DOCUMENTS

| | | | |
|---|---|---|---|
| 284,018 | 8/1883 | Hynson | 432/224 |
| 423,496 | 3/1890 | Sherman | 432/224 |
| 954,623 | 4/1910 | Grahn | 432/224 |
| 1,052,512 | 2/1913 | Phillips | 432/224 |
| 1,125,930 | 1/1915 | Arnemann | 432/224 |
| 2,194,433 | 3/1940 | Schonck | 432/224 |
| 2,294,168 | 8/1942 | Francis et al. | 432/224 |
| 3,050,297 | 8/1962 | Walter | 432/224 |
| 4,830,675 | 5/1989 | Skolnik | 134/3 |
| 4,906,301 | 3/1990 | Skolnik | 134/3 |

*Primary Examiner*—Asok Pal

[57] ABSTRACT

An oven-apparatus for koshering container or drum lids made of metal. The oven-apparatus has a substantially hollow interior through which are conveyed the lids after having passed through a bath, with the lids being conveyed through the hollow interior in a semicircular or arcuate path, with the entrance being positioned directly in-line with the exit of a conventional bath for initially washing the lids clean. The same conveyer system that conveys the series of lids through the bath is also used for conveying the lids through the oven-apparatus. After having passed through the oven-apparatus of the invention, the lids are conveyed in the conventional manner substantially parallel to but in the opposite direction by which they were conveyed through the bath. Within the hollow interior of the oven-apparatus, there are provided a pair of flame-burners. One flame-burner is mounted at a first corner of the housing of the oven-apparatus at an acute degree angle with respect the center line of the main housing. The second flame-burner is positioned at an opposite corner also at an acute angle with respect to the center line of the main housing but with an opposite sense as compared with the first burner. The flame-burners flame-treat each lid as it is transported through the oven-apparatus, on opposite surface faces of the lid.

16 Claims, 2 Drawing Sheets

PROCESS AND APPARATUS FOR KOSHERING CONTAINER LIDS

CROSS-REFERENCE TO RELATED APPLICATION

This is a continuation-in-part application of application Ser. No. 07/550,298, filed July 9, 1990. Said application Ser. No. 07/550,298 is a continuation-in-part of application Ser. No. 07/348,803 filed 08/08/88, which is in turn a continuation-in-part of application Ser. No. 07/131,291, filed 12/08/87, now U.S. Pat. No. 4,830,675, which is a continuation of application Ser. No. 06/872,016 filed 06/09/86, now abandoned.

BACKGROUND OF THE INVENTION

The present invention relates generally to the processing of manufactured metallic containers and, in particular to a process and apparatus for koshering the lids that form part of metallic containers. In the above-identified, commonly-owned, copending application, there is disclosed an apparatus for koshering metallic containers before the top and bottom closure-lids have been placed thereon. The present invention is directed to an apparatus and a process for achieving the koshering of these top and bottom closure-lids.

In commonly-owned, copending application Ser. No. 07/348,803, filed on May 8, 1989, there is disclosed another oven by which the flame-treating of these metallic containers may be carried out.

The strict Jewish dietary laws by which it is determined that foods are kosher require total abstinence from certain foods, prohibit the mixing of certain types of food on a single plate or at a single meal, and also prescribe the manner in which an animal, in order to be considered kosher, must be raised, butchered, and cooked. For example, according to Mosaic Law, certain foods such as pork products and shrimp are inherently not kosher and cannot be prepared to render them kosher. It is also a requirement of the dietary laws that meat dishes and dairy dishes cannot be consumed together, so that otherwise kosher foods, if improperly combined in a single meal will render the meal non-kosher even though the individual components themselves are prepared according to the laws of kosher.

When a vessel, such as a cooking pot, is used to prepare a meat dish, and must thereafter be used to prepare a dairy dish, the vessel must be cleaned thoroughly enough to remove all vestiges of the previously prepared meat dish, such as by the use of boiling water, steam, or flame drying. To my knowledge, there has been no practical method developed to date to adapt such a koshering process to large-volume containers, such as 55 gallon drums. If, for example, the food to be stored is "dairy" in nature, the presence of any contaminant traceable back to a "meat" origin may destroy the kosher character of the food. In like fashion, any "non-kosher" contaminant may also produce the same result.

Problems can then arise when, after food has been prepared in a kosher manner, it is stored in such a way that the storage vessel becomes a vehicle for contaminants which, while not adulterating the food in a medically harmful sense may still contribute contaminants of a character sufficient to destroy the kosher integrity of the food.

As an example, certain metallic containers, such as cans or drums used for the bulk storage and transportation of foods may, during the manufacturing process, may come in contact with, and be coated with a thin film of oil or grease, the presence of which in an otherwise kosher food may destroy the integrity of the koshering process.

Foods prepared in accordance with the dietary laws are certified as kosher by one trained to observe the entire manufacturing process and determine whether the method of preparing the food and the individual ingredients are consistent with the practice and observance of the dietary laws. In much the same manner, the same determination must be made with respect to the preparation of packaging for the food so prepared.

U.S. Pat. Nos. 4,830,675 and 4,906,301—Skolnik, which patents are incorporated by reference herein, disclose a method for achieving the koshering of the above-mentioned drums, in which the surfaces of the drums are subjected to flame-treatment for burning off any residue of oils, fats, and the like.

SUMMARY OF THE INVENTION

It is the primary objective of the present invention to provide a process and an oven-apparatus by which the flame-treatment of drum-lids is carried out in a manner that ensures the koshering of the lids.

It is another objective of the present invention to provide such a flame-treating oven-apparatus that flame-treats a series of drum-lids transported therethrough via a conveyer system.

It is another objective of the present invention to provide such an oven-apparatus at one end of a conventional drum-lid bath, so that immediately after each lid has been washed clean by the drum-lid bath, it enters into the oven-apparatus of the invention for the flame-treatment thereof.

The oven-apparatus of the invention has a substantially hollow interior through which are conveyed the lids after having passed through the water bath, with the lids being conveyed through the hollow interior in a semicircular or arcuate path, with the inlet or entrance being positioned directly in-line with the exit of a conventional hot-water bath for initially washing the lids clean. The same conveyer system that conveys the series of lids through the water-bath is also used for conveying the lids through the flame-treating oven apparatus. After having passed through the oven-apparatus of the invention, the flame-treated lids are conveyed in the conventional manner substantially parallel to but in the opposite direction by which they were conveyed through the water bath. Within the hollow interior of the oven-apparatus, there are provided a pair of flame-burners. One flame-burner is mounted at a first corner of the housing of the oven-apparatus at an acute degree angle with respect the center line of the main housing. The second flame-burner is positioned at an opposite corner also at an acute angle with respect to the center line of the main housing but with an opposite sense as compared with the first burner. The first burner's flames flame-treat the first surface-face of each lid transported through the oven-apparatus, while the second burner flame-treats the second, opposite surface-face at the same time.

BRIEF DESCRIPTION OF THE DRAWINGS

The invention will be more readily understood with reference to the accompanying drawing, wherein.

DETAILED DESCRIPTION OF THE INVENTION

Figure 1:
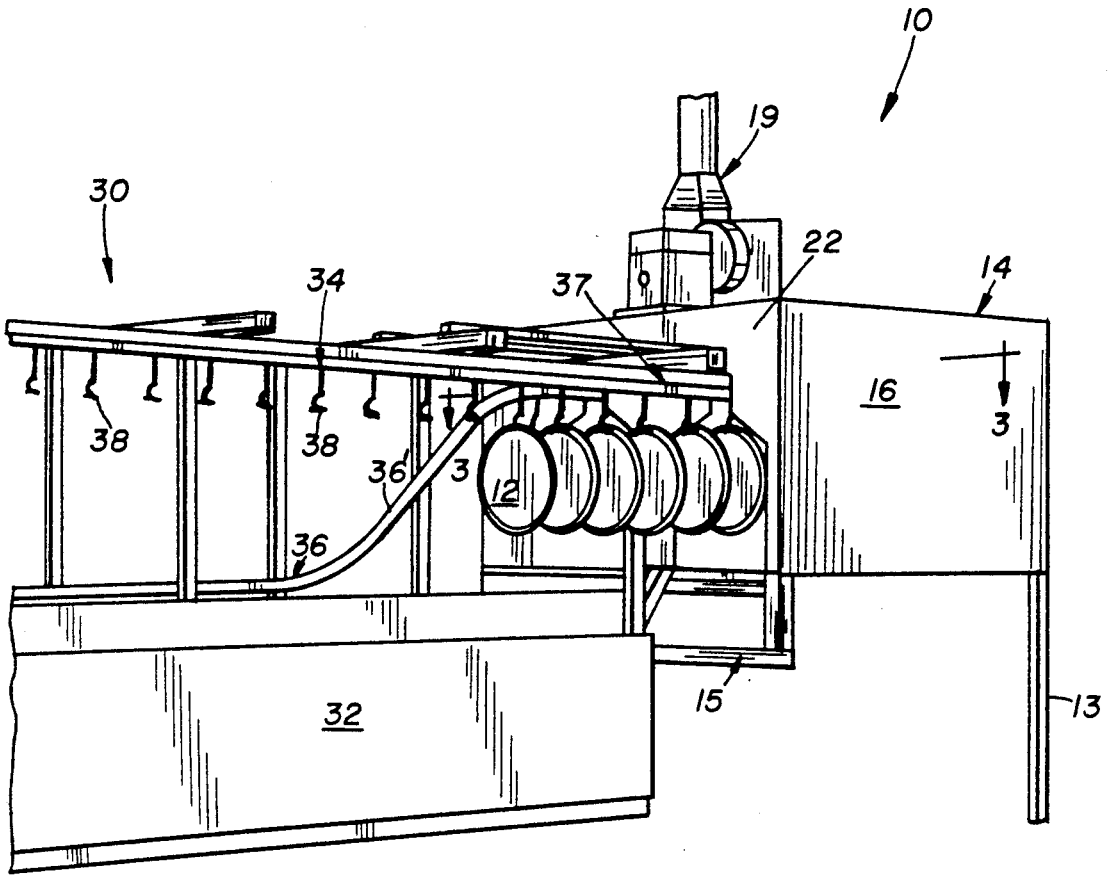
FIG. 1 is an isometric view of the oven-apparatus of the invention for carrying out the flame-treatment of container-lids, and also showing a conventional hot-water bath at the exit of which is mounted the oven-apparatus of the invention.

While use of the oven-apparatus of the invention disclosed herein may be extended to container-lids of varying sizes and configurations, a preferred use of the presently-described oven-apparatus is directed primarily to relatively large containers, such as steel drums having a capacity of about 55 gallons. Such drums are typically cylindrical in shape and have lids which may be either strapped, crimped, or otherwise attached to close off the drum. Access to the drum may thereafter be had by removing the lid, or through a hole or port formed in the lid.

Referring to figures, there is shown the oven-apparatus 10 of the invention used in flame-treating container or drum lids. 12. The apparatus 10 includes a main housing 14 defining a pair of parallel side walls 16,16', an upper wall 18, a rear wall 20, a front wall 22, and a bottom wall 23, all made of heat-insulating material. The front wall 22 defines an opening or entrance or a pair of openings for defining ingress and egress of the conveyed lids through which are conveyed the lids 12 for flame-treatment in the oven 10. The main housing 14 is supported at its rear by a pair of legs 13 which rest on the floor, so that the oven 10 proper is elevated enough above floor or ground level so as to align the opening or openings of the front wall 22 along the path of conveyed lids exiting from a lid-bath, described below in greater detail. The front of the main housing may be directly mounted to the rear of a lid-bath via cross-brace a mounting frame 15. The interior of the main housing is ventilated via a ventilator 19.

The oven 10 is positioned in close juxtaposition to a conventional bath 30, which bath may be a hot-water bath, a bath containing liquid rust inhibitor, or may be a phosphatizing bath. In the example shown in FIG. 1, the bath 30 is a hot-water bath which has a main tank 32 filled with water that is about 110–120 degrees F. It is, of course, within the scope and purview of the invention to place the oven 10 directly at the exit of one of the other baths just above-mentioned, which other conventional baths also have similar conveying systems as that shown in the FIGS. 1–3 and discussed below in greater.

A first or in-feeding portion of a conveying system 34 conveys the series of lids to be washed through the water-bath. This conveyer system includes a conveyer belt or chain 36 from which hang a series of spaced-apart hooks 38 for movement along with the conveyer belt 36, which individually support and suspend a container-lid therefrom, in the conventional manner. The conveyer system has its intermediate portion substantially low enough so that the suspended lids may pass through the water-bath 30, as seen in FIG. 1. The conveyer system 34 thereafter rises at the portion indicated by reference numeral 36' in FIG. 1 in order to raise the lids from the water bath when reaching the end of the bath. Thereafter, the conveyer system 34 turns about 180 degrees at its transition-portion 36'' seen in FIG. 3. After having turned a full 180 degrees, the return-portion 37 of the conveyer system returns the washed lids back to a storage area, for subsequent handling and for subsequent placement onto a drum. The return-portion 37 is a linear, raised section that spaces the lids above and laterally away of the water-bath 32 during the return-trip of the lids 12.

The above-described water bath and conveyer system therefor is conventional. The oven 10 of the invention utilizes the straight, end-portion of the section 36' and the straight end-portion of the return section 37, and the transition-portion or section 36'' for conveying the washed lids into the interior thereof and out of the interior thereof, such that these above-mentioned portions of the conveyer are received within the hollow interior of the oven, as clearly shown in FIG. 3. During the passage of the lids through the oven 10, each lid is flame-treated such that all exposed, exterior surfaces of each lid are exposed to and contacted by a flame for achieving the flame-treating, koshering of each lid.

Figure 2:
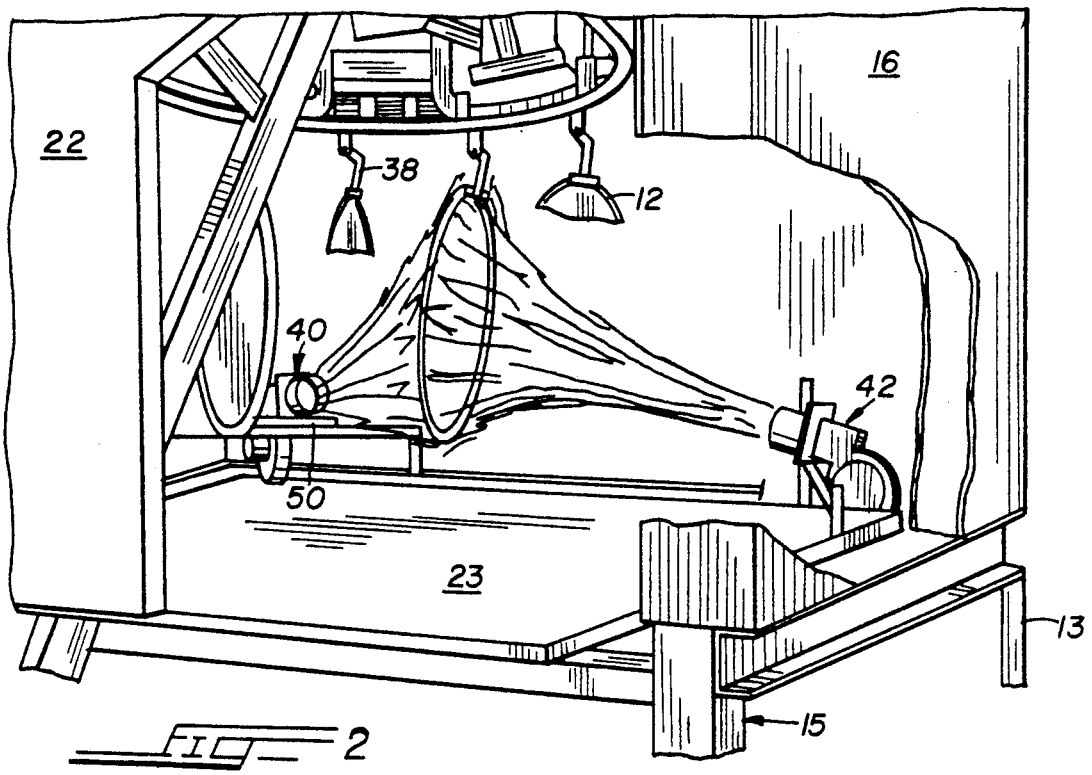
FIG. 2 is an isometric view showing the interior of the oven-apparatus where each container-lid is flame-treated according to the invention, as each lid is being conveyed through the oven-apparatus along a semicircular or arcuate path therethrough.
Figure 3:
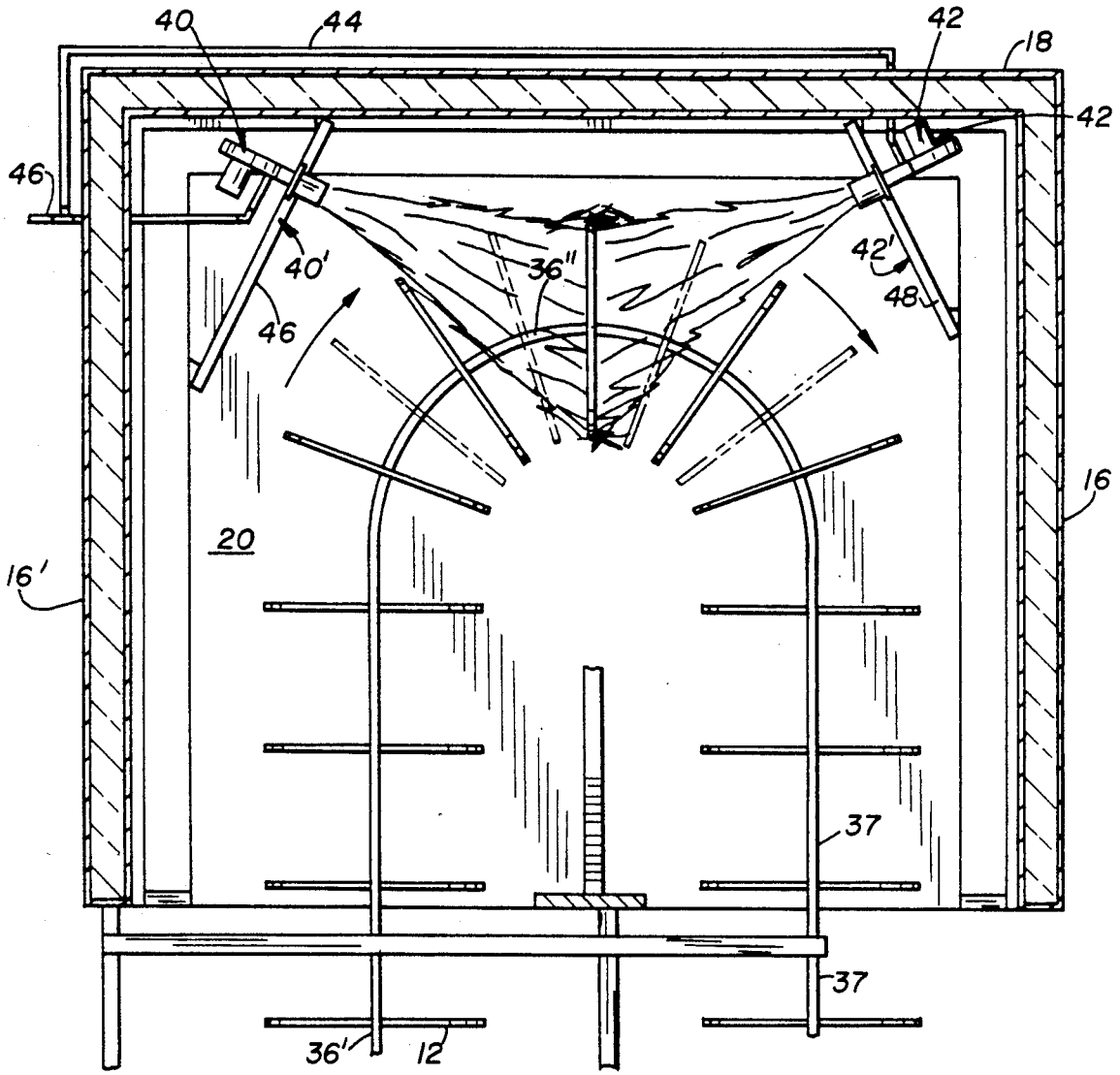
FIG. 3 is a cross-sectional view taken along line 3—3 of FIG. 1.

Referring to FIG. 3, there is shown a pair of flame-burners 40, 42, mounted in the interior of the main housing 14 at the two corners thereof formed by the rear wall 18 and the two side walls 16, 16'. Each burner 40, 42 during the flame-treatment of a series of conveyed lids is continuously operated, and in the preferred embodiment is a one-million BTU, conventional, gas-burner, and may be that manufactured by Eclipse Manufacturing Company, model JIB. The burners are supplied gas via a common tubing 44 from a source-pipe 46. The gas burners 40, 42 are mounted at a respective corner via a mounting plate assembly 40', 42', respectively. In the preferred embodiment, each mounting assembly is affixed to the rear wall 18 and a respective side wall 16, 16' via an angle-bracket 46, 48, respectively, which mounts the respective gas burner directly. Since each angle-bracket 46, 48 is spanned across the rear wall and a side wall, it forms an acute angle with respect to these walls, such that each gas burner 40, 42 faces in the direction of transition-portion 36'' of the conveyer system, so that as the lids 12 are conveyed therepast, the flames from the gas-burners will contact all of the surfaces of each lid. That is, the flames from the burner 40 will contact the surface face of each lid facing it, as seen in FIG. 3, while the flames from the burner 42 will contact the surface of each lid facing it. The angle-bracket 46 or 48 is mounted below the vertical lever of the transition-section 36'' of the conveyer system, so each burner 40, 42 is also mounted angularly upwardly by a cross-piece 50 seen in FIG. 2. Each cross-piece 50 is connected to a respective angle-bracket 46, 48, whereby the longitudinal axis of each gas-burner forms not only acute angle (preferably of 45 degrees) with respect to the rear wall 18, but also forms an acute angle with respect to the bottom wall 23, as seen in FIG. 2.

As can be seen in FIG. 3, each burner is preferably mounted on a rearward section of the respective angle-bracket, so that the flames from each burner are directed to the apex or center area of the transition-portion 36''. Preferably, for maximum flame-treating effect, the longitudinal axis of each burner is an approximate tangent to the curved transition-portion 36'', although this is not a requirement. By directing the flames from the gas burners to the apex of the transition section 36'', it is ensured that all surfaces of the lid are flame-treated. In addition, since the flames from each burner form an expanding cone-shape, as seen in FIG. 3, it is not only ensured that each surface face of the each lid is contacted by flames, but it is also ensured that the circumferential edge surface of each lid is also contacted by the flames. This is achieved by the provision of gas burners that produce flames that will more than encompass the full lid, so that the flames contact the full circumference of the rim of each lid, from each side of the lid, especially owing to the relatively thin nature of the lid.

While a specific embodiment of the invention has been shown and described, it is to be understood that numerous changes and modifications may be made therein without departing from the scope, spirit and intent of the invention as set forth in the appended claims.

What we claim is:

1. An apparatus for flame-treating metal lids of containers, drums, and the like, comprising:

a main housing comprising a rear wall, a pair of side walls, a top wall, and a front wall, said main housing having a substantially hollow interior through which may be conveyed lids to be flame-treated, said front wall having at least one entrance opening through which may pass the lids to be flame-treated;

a first flame means for producing flames, for flame-treating at least one surface face of a lid, mounted in said hollow interior;

a second flame means for producing flames, for flame-treating at least the other side surface of a lid, also mounted in said hollow interior;

conveyer means for conveying a series of lids to be flame-treated through said entrance of said front wall and into and out of said hollow interior of said main housing, said conveyer means comprising a first section for conveying lids into said hollow interior of said main housing, a second intermediate arcuate section for conveying the series of lids through said hollow interior, and a third section for conveying the series of lids out of said main housing after having been flame-treated by said first and second flame means;

said first flame means being mounted adjacent one of said pair of side walls, and said second flame means being mounted adjacent the other of said pair of flame means, each of said first and second flame means having a main directing portion through which exit the flames, each said main directing portion being directed toward said intermediate section of said conveyer means for directing the flames thereof toward the lids being transported thereby.

2. The apparatus according to claim 1, wherein said first flame means comprises a first gas burner, and first mounting means for mounting said first gas burner to one said wall of said main housing; said main directing portion of said first gas burner having a first longitudinal axis, said first longitudinal axis forming an acute angle with respect to said rear wall of said main housing.

3. The apparatus according to claim 2, wherein said second flame means comprises a second gas burner, and second mounting means for mounting said second gas burner to one said wall of said main housing; said main directing portion of said second gas burner having a second longitudinal axis, said second longitudinal axis forming an acute angle with respect to said rear wall of said main housing.

4. The apparatus according to claim 3, wherein said conveyer means is elevated above said first and second flame means; each said longitudinal axis sloping upwardly to form an angle with respect to the horizontal, whereby the flames projecting from each said gas burner are directed upwardly toward the series of lids moving therepast via said conveying means.

5. The apparatus according to claim 1, wherein said first and third sections of said conveyer means are substantially parallel to each other, said second intermediate section being semicircular in shape and having a first end connected to the end of said first section, and a second end connected to the end of said third section, whereby said second intermediate section reverses the direction of conveyance of the series of lids in said main housing.

6. The apparatus according to claim 1, wherein said first flame means comprises first supply tube means for supplying gas to said first flame means, and said second flame means comprises second supply tube means for supplying gas to said second flame means.

7. The apparatus according to claim 2, wherein said main housing also comprises a bottom wall; each of said of first and second mounting means mounting said first and second gas burners, respectively, in close proximity to said bottom wall.

8. The apparatus according to claim 1, wherein said conveyer means comprises a series of downwardly-extending lid-suspending members for holding and vertically-suspending the series of lids therefrom; said conveyer means comprising means for moving said lid-suspending members along said first, second, and third sections of said conveyer means.

9. The apparatus according to claim 1, in combination with a lid-bath for the lids, said lid-bath having an exit end juxtapositioned near said entrance of said of front wall of said main housing so that lids exiting from said lid-bath thereafter enter into said main housing via said conveying means.

10. The apparatus according to claim 9, wherein said conveyer means also transports the lids through said lid-bath before conveying the lids into said hollow interior of said main housing.

11. The apparatus according to claim 10, wherein said conveyer means further comprises another lower section that is at a lower elevation than said first, second, and third sections, said another lower section transporting the lids through the lid-bath, said conveyer means also comprising a sloping section connecting said another lower section to said first section for gradually elevating the lids to raise them out of the lid-bath.

12. The apparatus according to claim 9, wherein said main housing further comprises frame means for supporting said main housing on a floor and elevating said walls of said main housing above the floor, said frame means elevating said main housing so that said entrance opening of said front wall is positioned at approximately the same elevation as said exit end of said lid-bath.

13. A combination metal lid bath and flame-treatment apparatus for lids for koshering metallic lids after exiting from the lid-bath, comprising:

a lid-bath in which container-lids are immersed, said bath having an exit end from which the lids exit;

a flame-treating apparatus for exposing the lids to flames after exiting from said lid-bath; and conveyer means for conveying lids through said lid-bath, out therefrom, and into, through, and out of said flame-treating apparatus, said conveyer means comprising lid-holding and suspending means for suspending a series of container lids is spaced apart condition along said conveyer means.

14. The combination according to claim 13, said flame-treating apparatus comprises:

a main housing comprising a rear wall, a pair of side walls, a top wall, and a front wall, said main housing having a substantially hollow interior through which may be conveyed lids to be flame-treated, said front wall having at least one entrance opening through which may pass the lids to be flame-treated;

a first flame means for producing flames, for flame-treating at least one surface face of a lid, mounted in said hollow interior;

a second flame means for producing flames, for flame-treating at least the other side surface of a lid, also mounted in said hollow interior;

said conveyer means comprising a first section for conveying lids into and out of said lid-bath and into said hollow interior of said main housing, a second intermediate arcuate section for conveying the series of lids through said hollow interior, and a third section for conveying the series of lids out of said main housing after having been flame-treated;

said first flame means being mounted adjacent one of said pair of side walls, and said second flame means being mounted adjacent the other of said pair of side walls, each of said first and second flame means having a main directing portion through which exit the flames, each said main directing portion being directed toward said intermediate section of said conveyer means for directing the flames thereof toward the lids being transported thereby.

15. The combination according to claim 14, wherein said first flame means comprises a first gas burner, and first mounting means for mounting said first gas burner to one said wall of said main housing; said main directing portion of said first gas burner having a first longitudinal axis, said first longitudinal axis forming an acute angle with respect to said rear wall of said main housing;

said second flame means comprising a second gas burner, and second mounting means for mounting said second gas burner to one said wall of said main housing; said main directing portion of said second gas burner having a second longitudinal axis, said second longitudinal axis forming an acute angle with respect to said rear wall of said main housing.

16. The apparatus according to claim 15, wherein said conveyer means is elevated above said first and second flame means; each said longitudinal axis sloping upwardly to form an angle with respect to the horizontal, whereby the flames projecting from each said gas burner are directed upwardly toward the series of lids moving therepast via said conveying means.

* * * * *